US005875504A

United States Patent [19]

Tambling

[11] Patent Number: 5,875,504

[45] Date of Patent: Mar. 2, 1999

[54] DEVICE FOR ENLARGING A REGION OF A BOOT OR SHOE

[76] Inventor: Michael Ronald Tambling, 1671 Lake Murray Blvd., Columbia, S.C. 29212

[21] Appl. No.: 829,853

[22] Filed: Apr. 1, 1997

Related U.S. Application Data

[60] Provisional application No. 60/014,800 Apr. 4, 1996.

[51] Int. Cl.[6] ..... A43D 5/00; A43D 15/00

[52] U.S. Cl. ..... 12/114.2; 12/114.6; 12/115.2; 12/115.6; 12/115.8

[58] Field of Search ..... 12/114.2, 114.6, 12/115.2, 115.4, 115.6, 115.8, 116.2, 116.4, 116.8, 119.5

[56] References Cited

U.S. PATENT DOCUMENTS

| | | | |
|---|---|---|---|
| 416,775 | 12/1889 | Cash | 12/115.2 |
| 1,097,437 | 5/1914 | Holzemer et al. | 12/115.2 |
| 1,117,818 | 11/1914 | Ellmann | 12/115.2 |
| 1,453,608 | 5/1923 | Sprague | 12/115.2 |
| 1,465,271 | 8/1923 | Howe | 12/115.8 |
| 2,000,340 | 5/1935 | La Marca et al. | 12/115.2 |
| 2,107,140 | 2/1938 | Cirelli | 12/115.2 |
| 2,116,917 | 5/1938 | Ventola | 12/114.6 |
| 3,239,860 | 3/1966 | Iredale | 12/115.8 |
| 3,276,053 | 10/1966 | McKesson | 12/114.6 |
| 3,952,357 | 4/1976 | O'Sullivan | 12/115.2 |
| 3,965,515 | 6/1976 | Moberly | 12/114.6 |
| 4,060,869 | 12/1977 | Brown . | |
| 4,185,347 | 1/1980 | Yang | 1/114.6 |
| 4,512,052 | 4/1985 | Bruno | 12/116.2 |
| 4,567,617 | 2/1986 | Limbach . | |
| 5,337,432 | 8/1994 | Pirhonen . | |
| 5,373,596 | 12/1994 | Harrell . | |

*Primary Examiner*—M. D. Patterson
*Attorney, Agent, or Firm*—Michael A Mann; Nexsen Pruet Jacobs & Pollard LLP

[57] ABSTRACT

The present invention is a device used in conjunction with a heat source to locally enlarge an area of a ski boot. The devices comprise a spreader and an extender. The spreader mechanically forces apart a pair of curved elements or "shoes" that apply pressure to both the medial and lateral side of a boot. The shoes on the spreader may be replaced or pivoted in order to use the spreader to enlarge the upper portion of the boot. The extender has a slot, a toe shoe, and a heel shoe that conform to the corresponding regions of the boot. The spreader fits within and matingly engages the slot of the extender and applies a force from within the slot, thus causing the extender to transmit this force to the toe and heel region. In all of the above instances the area of desired enlargement is heated prior to application of force to remove the elasticity of the outer shell temporarily so that the stretching is permanent.

18 Claims, 5 Drawing Sheets

DEVICE FOR ENLARGING A REGION OF A BOOT OR SHOE

BACKGROUND OF THE INVENTION

1. Field of the Invention

The present invention relates to devices for custom fitting foot gear. In particular, the present invention relates to devices for enlarging specific areas within a shoe or boot, such as a ski boot. Applicant claims the benefit of the filing date of his provisional application, Ser. No. 60/014,800, filed Apr. 4, 1996.

2. Discussion of Background

A ski boot should transfer the movements of a skier's foot directly to the ski. A typical ski boot comprises a hard plastic outer shell with an inner boot made from a flexible material. A ski boot should fit a skier's foot comfortably, but snugly to transfer movement of the foot to the boot, and then to the ski to which the boot is rigidly attached. Unfortunately, with the infinite number of shapes that feet come in, providing a set of standard sizes of ski boots that fit feet perfectly is not possible. While it may be possible to make a mold and form an inner flexible boot to perfectly fit a skier's foot, this method does not always work the best. For instance, the inner boot is able to flex and change shape depending on the type and direction of forces that the skier's foot exerts on the inner boot. Consequently, the inner boot, after extended use, will no longer fit the skier's foot as snugly as it did when new. Additionally, it is not practical to make a mold for every skier's foot as the cost per skier would be prohibitive for most skiers.

There have been attempts in the prior art to devise methods and implements to customize ski boots. For example, see U.S. Pat. No. 5,337,432 which issued Aug. 16, 1994 to Pirhonen and U.S. Pat. No. 4,060,863 which issued Dec. 6, 1977 to Brown. Each of these references shows a device that works in conjunction with a heating element to locally heat the outside portion of the outer shell of the ski boot. The implements described in these patents exert a force against the boot from its interior and against one side of the boot, while the exterior is being heated. The application of force against a heated boot results in the boot being locally expanded. Moreover, in each of the above references, a hydraulic unit is used to supply this force solely to the medial side of the boot. However, there is a need in many instances to stretch the lateral side of the boot, or possibly the toe or heel areas. Additionally, it may be necessary to stretch the lower leg portion of the ski boot, for which the above devices are unsuitable. Furthermore, the use of hydraulic equipment within the boot can result in hydraulic fluid leaks within the interior of the boot. Consequently, there is a need for a device that is simple to use and easy to manufacture for locally enlarging or stretching a variety of areas within a ski boot.

SUMMARY OF THE INVENTION

According to its major aspects and broadly stated the present invention is a device for locally enlarging a region of shoes or boots, such as, especially, a ski boot, to fit a skier's foot. The present invention comprises a spreader and an extender. The spreader is a mechanical device having a pair of curved forms or "shoes" on shoe holders mounted on mechanically-movable arms for locally enlarging the medial or lateral side of the boot. The shoe that corresponds to the lateral side of the boot is larger than the shoe on the medial side. Each shoe is curved to conform to the typical contour of that side of a skier's foot and both are removably attached to the shoe holder. The shoe holders are themselves each pivotally connected to the arms so that as the arms are spread apart, the distance between the shoes and the shoe holders increases. The arms engage an actuator that moves that arm apart as it is moved longitudinally between the arms; the actuator is controlled by the rotation of a knob positioned on a threaded rod. As the actuator is moved back and forth along the threaded rod, the shoes and shoe holders are forced apart from each other or are brought back together. Consequently, the force that is exerted by the shoes onto the interior of the boot along both the medial and lateral sections of the boot is controlled simply by the rotation of a knob. Because the mechanical force is augmented by heating the boot, either the medial or lateral side of the boot can be expanded depending on which side of the boot is heated.

The spreader may also be used to expand the upper portions of the ski boot by pivoting the shoes 90° and inserting the spreader into the upper portion of the boot. Once in position, the knob can be turned to exert pressure from the interior of the upper portion of the boot. This in combination with a localized heating of the exterior of the boot, will enlarge the heated area.

The spreader can also be used in conjunction with an extender to enlarge either the toe or heel region. The extender is an elongated, two part structure in which the parts slide between a compressed position and an extended position. The extender has an internal slot with a peg formed on each end of the slot. When the shoes of the spreader are removed from the spreader, a notch is exposed within each shoe holder. These notches matingly engage the pegs within the slot of the extender, so that, when the knob on the spreader is turned, the shoe holders are forced apart from each other and the two parts of the extender slide to the extended position to apply a force on both the heel and toe region of the boot. The enlarging is controlled by locally heating the desired region, thus providing accurate control for the enlarging process. The extender is also provided with a third part, namely a spacer, that can be removed, if necessary, when the boot is of a relatively small size.

The use of the spreader directly and in combination with the extender to adjust the shape of the boot is an important feature of the present invention. This feature has the advantage of complete flexibility in custom-fitting the boot. Using the spreader and extender, not only can the sides of the boot toe box be extended, but the toe itself, the heal, and the upper part of the boot. Being able to expand the upper part of the boot is especially important for many female skiers, whose calf muscles tend to extend farther down the leg.

The use of a simple mechanical apparatus for spreading the shoes of the spreader is another important feature of the present invention. This mechanism is structured to provide sufficient force where it is needed with precise control. The knob, actuator, arms, and threaded rod make the present device simple to manufacture, use, and clean because there is no hydraulic fluid to leak, and is precisely controllable. If the area of the boot that is to be stretched is properly warmed, then delivering sufficient force is not a concern, only the control of the force and the direction of its application.

Still another feature of the present invention is the spreader having a pair of shoes. By having two shoes, each with a different shape depending on the particular side of the foot, the shoes can exert an evenly distributed force on each side of the boot, while the localized area of enlargement is controlled by the regional heating. The spreader can operate just as well on a left boot as a right boot simply by turning it over.

Yet another feature of the present invention is that the shoes are pivotally and removably connected to the shoe holders. By pivoting the shoes the spreader may be used to locally enlarge an area of the upper portion of the boot, for instance when a person has a usually large calf muscle. Additionally, for enlarging the upper portion of the boot, larger shoes may be substituted for the other shoes, thus providing a more evenly distributed force.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
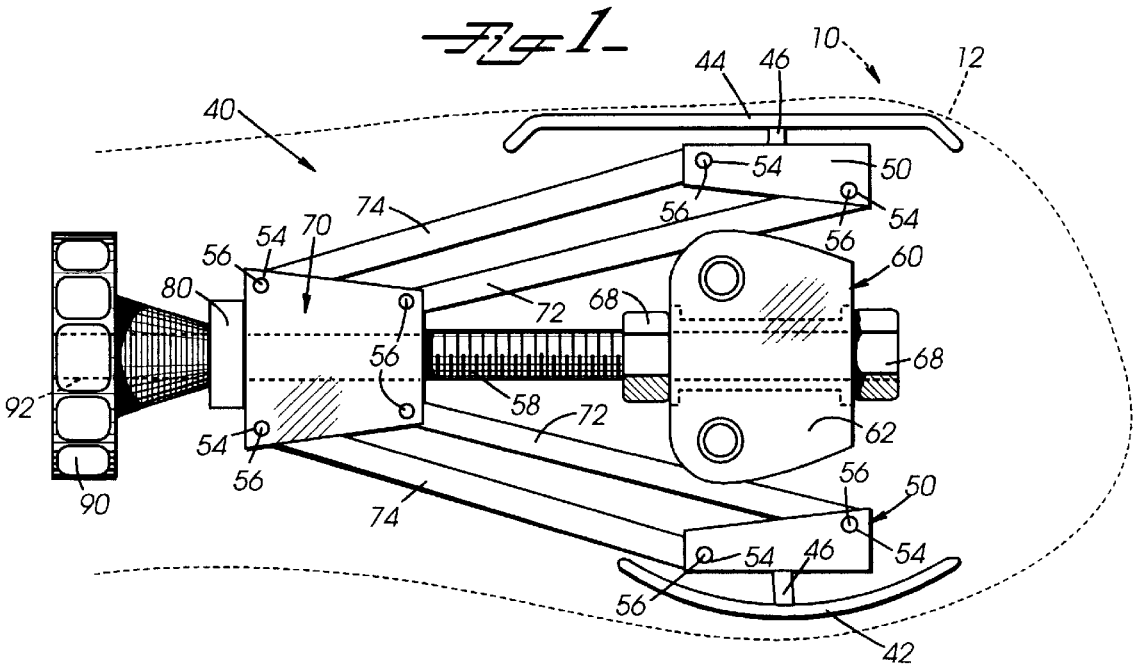
FIG. 1 is a top view of a spreader positioned within a ski boot, shown in phantom lines, according to a preferred embodiment of the present invention.

Referring now to the Figures, the present invention is a pair of devices 30 for locally enlarging a portion of a ski boot 10, where the devices 30 are used in combination with a heating source 18 that is capable of heating an isolated area on the exterior of ski boot 10. Devices 30 comprise a spreader 40 and an extender 100, and as mentioned above is preferably used with ski boot 10. Ski boot 10 comprises an inner boot 12 and an outer shell 14, which is generally constructed from a hard plastic. In order to enlarge a particular region of ski boot 10 to fit a person's foot, a force must be exerted from within the interior of ski boot 10, while the exterior, or hard plastic outer shell 14, is being heated. The heat increases the elasticity of the plastic which in combination with the interior forces causes the hard outer shell 14 to deform and change shape. Once the desired shape has been achieved the heating process is stopped and outer shell 14 becomes as hard and as rigid as before; however, when cooled, it will be a different shape than before, conforming to a particular foot.

Figure 11:
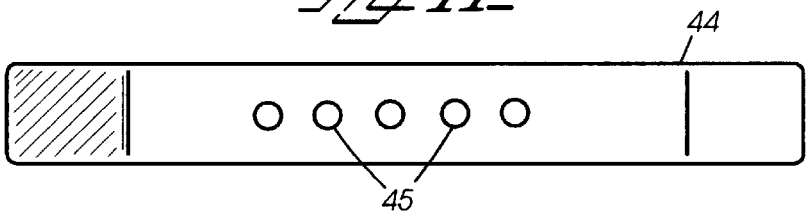
FIG. 11 is a side view of lateral shoe suitable for use in a preferred embodiment of the present invention.

Spreader 40 comprises a medial shoe 42 and a lateral shoe 44, both having a peg 46 threaded into a nut formed on the interior side, or other convenient mode of attachment. Shoe 42 has a generally arcuate shape; shoe 44 has a generally flatter and longer shape with curved ends. Those of ordinary skill in the art will recognize that the differences in the sizes and shapes of shoes 42, 44 generally correspond to the shape of a foot. Lateral shoe 44 has a series of holes 45—preferably three to five holes—formed along its length, as best seen in FIG. 11. These enable the user to attach lateral shoe 44 to peg 46 at any of the holes provided to allow flexibility in adjusting spreader 40 to an individual's foot.

Figure 10A:
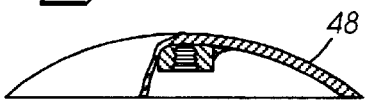
FIGS. 10A and 10B are top and side views of an alternative design for a medial side shoe suitable for use in a preferred embodiment of the present invention.
Figure 10B:
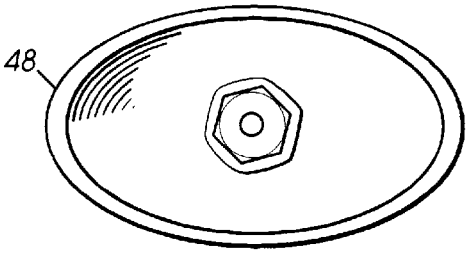

An alternative embodiment of medial shoe 42 is shown in FIGS. 10A and 10B. Shoe 48 is specifically adapted for use in stretching a ski boot to accommodate a bunion. Shoe 48 has a smaller radius of curvature than shoe 42 and is oval (FIG. 10B) to match the shape of a bunion. For an individual who has a bunion, shoe 48 is substituted for shoe 42 and the boot stretched as will be described herein.

Both shoes 42, 44 are removably secured into a shoe holder 50 having a notch 52 formed therein, in which each peg 46 is insertable. The peg 46 and notch 52 combination securely holds shoes 42, 44 in place, but enables them to pivot or be easily removed, as will be described in detail below.

Spreader 40 also comprises a threaded rod 58 having an axis extending its length. Positioned on threaded rod 58 are an actuator 60, an arm holder 70, a thrust bearing 80, and a knob 90. Additionally, two lower arms 72 and two upper arms 74 are pivotally attached to arm holder 70 at one end and to shoe holders 50 at their other end. Specifically, one lower arm 72 and one upper arm 74 are each attached to one shoe holder 50, with the other arms 72, 74 attached to the other shoe holder 50.

It should be noted that spreader 40 is symmetric about the axis which extends the length of threaded rod 58, except for the differences between medial shoe 42 and lateral shoe 44, as described above. Consequently, during the description of spreader 40, it should be recognized that the description relating to one side of spreader 40 also relates to the other side.

As briefly discussed above, upper arms 74 and lower arms 72 are pivotally attached to arm holder 70 and shoe holders 50. In the preferred embodiment, each upper arm 74 and lower arm 72 that are attached to arm holder 70 and one shoe holder 50 are positioned approximately parallel to each other. Furthermore, upper arm 74 and lower arm 72 are attached to shoe holder 50, so that as upper arm 74 and lower arm 72 pivot, the relative orientation of shoes 42, 44 does not change with respect to the axis of threaded rod 58. In the preferred embodiment, the edges of shoe holders 50 are slightly off parallel with respect to threaded rod 58, so that shoes 42, 44 match the contour of boot 10, as it is formed.

In the preferred embodiment, shoe holders 50 are constructed from a channel shaped metal having a notch 52 formed therein. Additionally, shoe holders 50 have holes 54 formed therein which correspond to pins 56 which are inserted through holes 54 and through upper arms 74 and lower arms 72 to pivotally secure arms 72,74. Arm holder 70 is constructed such that it has an opening 76 extending its length with a pair of channels 78 formed on either side. Opening 76 permits threaded rod 58 to be inserted therethrough and channels 78 are designed to provide upper arms 74 and lower arms 72 clearance as they pivot. Located so that they are aligned over channels 78 are a plurality of holes 54 which extend through both sides of channel 78. As with shoe holders 50 holes 54 are designed to receive pins 56 therethrough with pins extending through upper arms 74 and lower arms 72, respectively.

Positioned below arm holder 70 on threaded rod 58 is actuator 60. Actuator 60 comprises an upper plate 62 and a lower plate 64 between which are positioned a pair of roller bearings 66. Roller bearings 66 are also positioned within actuator 60 symmetric to the axis of threaded rod 58.

Actuator 60 additionally comprises threaded receiving means through which threaded rod 58 is inserted and secured. In the preferred embodiment this threaded receiving means comprises a pair of nuts 68 positioned on the upper side and lower side of actuator 60. Those of ordinary skill in the art will recognize that there are numerous methods of threadably securing actuator 60 to threaded rod 58 without departing from the spirit and scope of the present invention.

Positioned on threaded rod 58 above arm holder 70 is a knob 90. Knob 90 has an opening 92 in its center through which threaded rod 58 passes. Opening 92 of knob 90 is threaded to matingly engage threaded rod 58, so that as knob 90 is rotated, knob 90 travels up or down the length of threaded rod 58. Positioned between knob 90 and arm holder 70 is a thrust bearing 80 that helps transfer the force from knob 90 to arm holder 70. This force is generated when knob 90 is rotated down the length of threaded rod 58, thus causing arm holder 70 to travel in the same direction and closing the distance between arm holder 70 and actuator 60. It should be appreciated that there are many substitute devices that may be used for knob 90 and thrust bearing 80.

Figure 2:
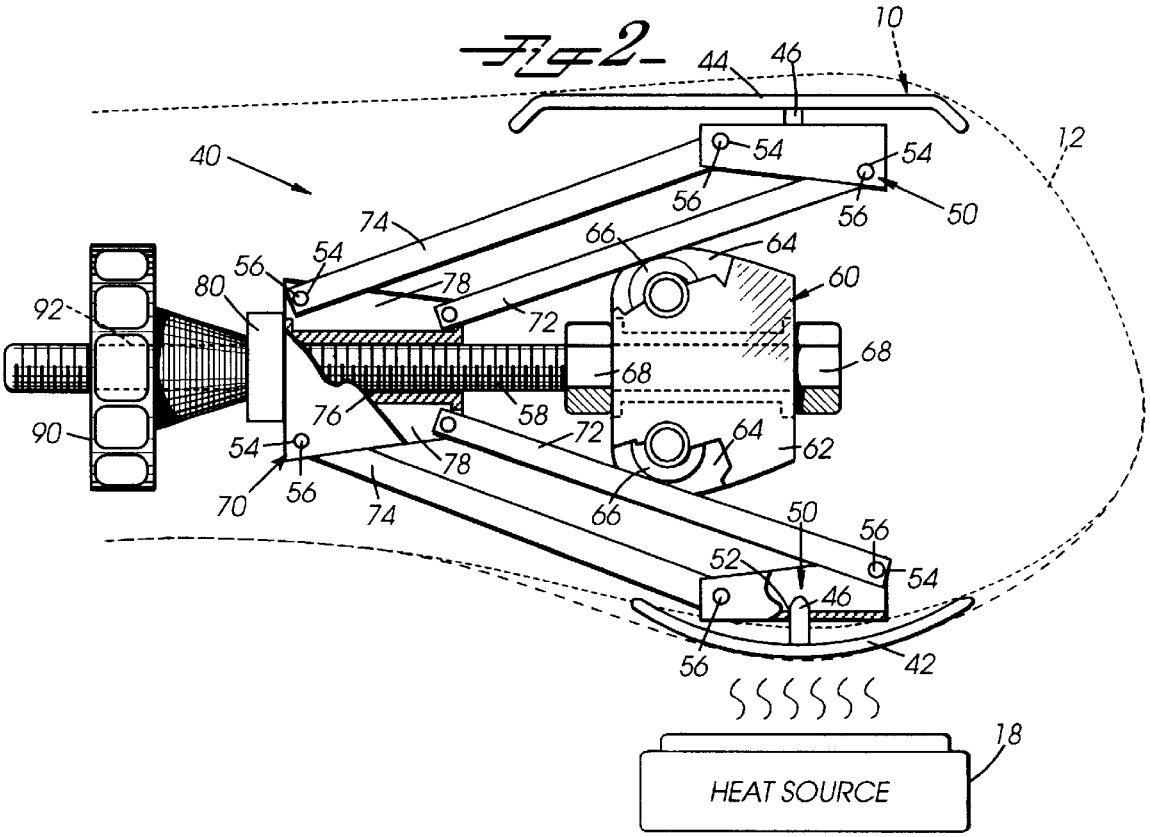
FIG. 2 is a top view of a spreader with a cut-out portion, where the spreader is positioned within a ski boot, shown in phantom lines, with the shoe holders widened according to a preferred embodiment of the present invention.
Figure 3:
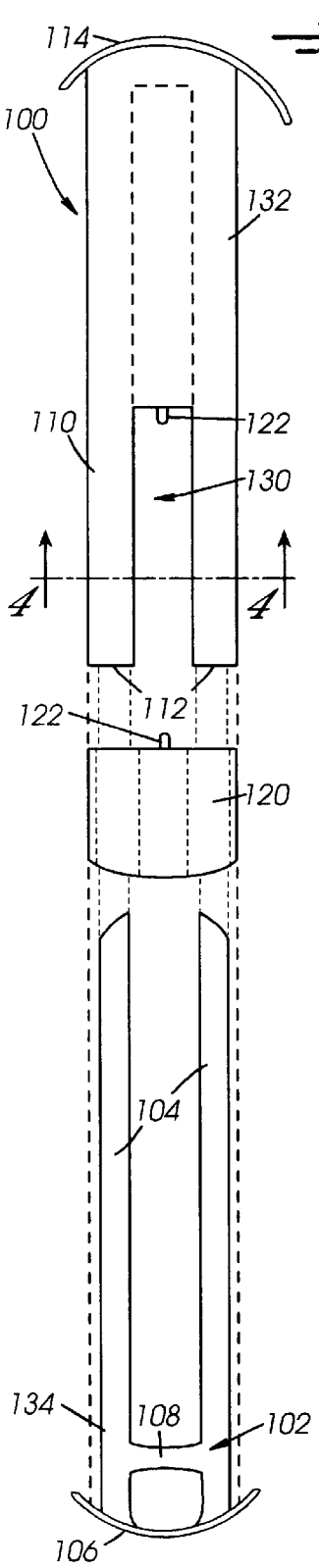
FIG. 3 is an exploded view of an extender according to a preferred embodiment of the present invention.
Figure 4:
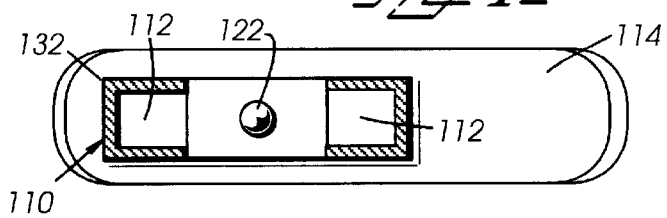
FIG. 4 is a cross-sectional view of an extender taken along lines 4—4 of FIG. 3, according to a preferred embodiment of the present invention.

In operation of enlarging a region of ski boot 10 that corresponds to the first or fifth metatarsals, as shown in FIGS. 1 and 2, spreader 40 is used with medial shoes 42 (or 48) and lateral shoe 44 to exert a force from the interior of ski boot 10. Peg 46 may be threaded to any of the holes on lateral shoe 44 which tends to self-seat against the lateral side of boot 10. The choice of hole depends on where the first metatarsal is located with respect to the lateral side of the foot.

To exert the force needed to stretch boot 10, spreader 40 is positioned within ski boot 10, and knob 90 is rotated on threaded rod 58 so that the distance between knob 90 and actuator 60 is decreased. As this distance decreases, lower arms 72 ride against roller bearing 66, and cause the distance between shoe holders 50 to increase, thus forcing them apart. If a resistance is encountered by shoe holders 50 as they are spread apart, knob 90 can still be turned to increase the amount of force that is applied to that region. To enlarge the region of ski boot 10 and stretch the hard plastic outer shell 14, a heat source 18 is applied to the exterior so that the plastic will become more elastic. Once the local area of boot 10 has been enlarged, heat source 18 can be removed. When the plastic cools, it will have a new shape.

Spreader 40 may also be used to stretch the upper portion 16 of ski boot 10 and the top of boot 10. In the first of these specific operations, medial shoe 42 and lateral shoe 44 are replaced with shoes 96 and pivoted 90° so that they are perpendicular to threaded rod 58. Shoes 96 are positioned within upper portion 16 and knob 90 is rotated, so that shoes 96 exert an outward force against the interior of ski boot 10. Again, localized heat is applied to the area of the hard plastic outer shell 14 to be enlarged and removed once the specific size of enlargement is obtained. These new shoes are also in an arcuate shape, yet have a greater length than either medial shoe 42 or lateral shoe 44. Consequently, the substitute shoes 96 may be used to more evenly distribute forces along the circular upper portion 16 of ski boot 10.

Figure 8:
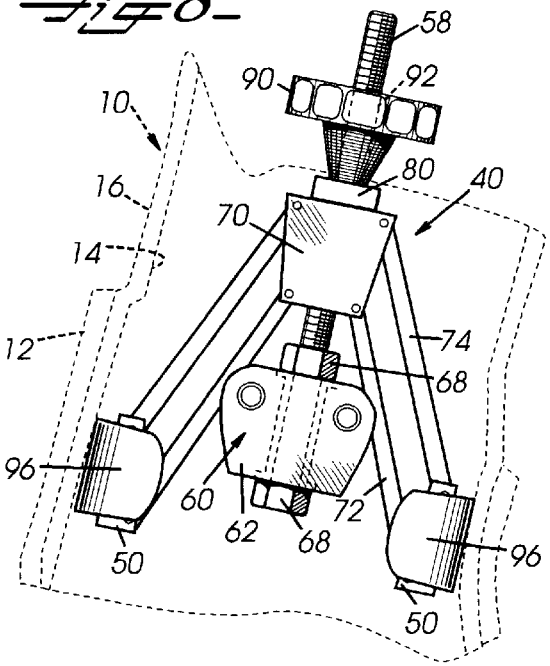
FIG. 8 is a side view of a spreader with its shoes pivoted and positioned within the upper portion of a ski boot according to a preferred embodiment of the present invention.
Figure 9:
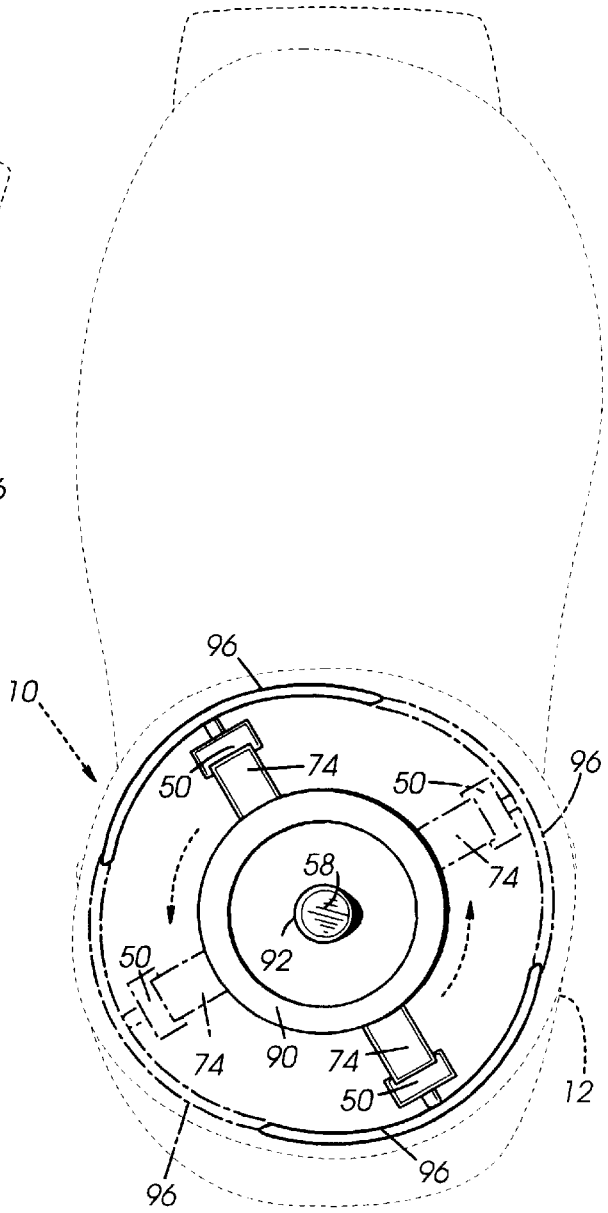
FIG. 9 is a top view of a spreader with its shoes pivoted and positioned within the upper portion of a ski boot, according to a preferred embodiment of the present invention.
Figure 12:
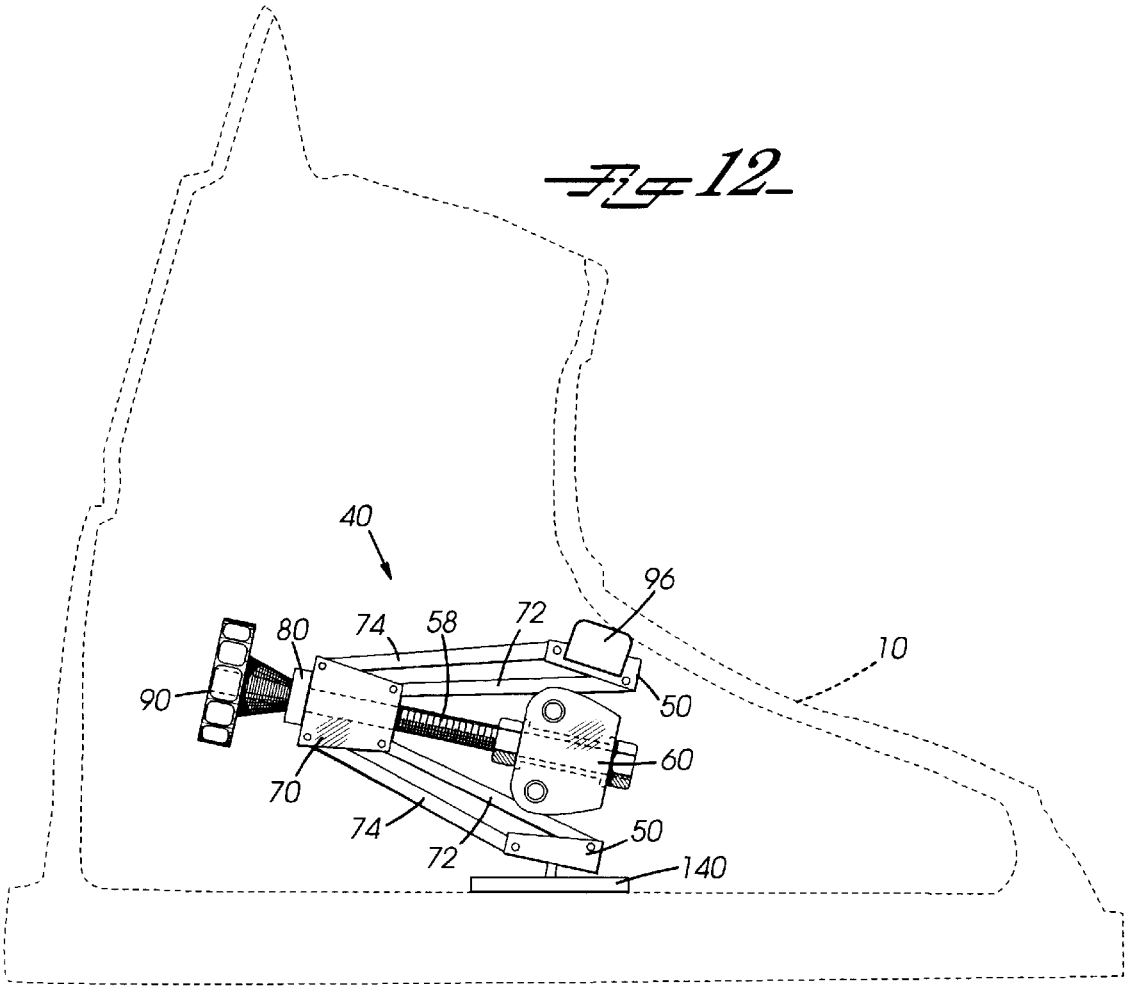
FIG. 12 is a side view of a boot with a device according to a preferred embodiment of the present invention inserted for stretching the top of the foot.

Similarly, a flat plate 140 is attached peg 46 on one side of spreader 40 and a substitute shoe 96, as illustrated in FIGS. 8 and 9, which will work well against the top 142 of boot 10, as illustrated in FIG. 12. Flat plate 140 is place in engagement with the floor 144 of boot 10 where shoe 96 will engage the boot top 142. Then heat is applied to the outside of boot 10 at top as knob 90 is rotated to force boot 10 to stretch. Preferably, spreader 40 is a smaller scale version of that used for stretching other parts of boot 10 to fit better for this operation.

Spreader 40 may also be used in combination with extender 100 to enlarge the toe or heel region. Extender 100 comprises an insert 102, a receiver 10, and a spacer 120. Insert 102 has a pair of tines 104 that extend from a heel shoe 106, that is designed to conform to the heel of the foot. Additionally, there is a brace 108 positioned between tines 104 proximate heel shoe 106 which provides support and rigidity to insert 102. Spacer 120 having channels (not shown) formed therein matingly fits over tines 104 of insert 102. Spacer 120 also has a peg 122 formed on one end, which faces away from heel shoe 106 when spacer 120 is positioned on insert 102 with tines 104 extending therethrough. Receiver 110 also has a pair of channels 112 formed therein which are designed to receive tines 104 of insert 102. Formed at the opposing end of receiver 110 is a toe shoe 114 that is adapted to match the anatomy and structure of the front of the foot and the toes. Toe shoe 114 extends a greater distance to the lateral side of the foot than to the medial side of the foot, while heel shoe 106 basically extends equidistant along the heel portion.

When spacer 120, insert 102, and receiver 10 are positioned together, a slot 130 is formed within extender 100. Slot 130 has a first end 132 proximate to toe shoe 114 and a second end 134 proximate to heel shoe 106. Peg 122 which is connected to spacer 120 is positioned at second end 134 of slot 130 and extends into slot 130. Another peg 122 is attached to receiver 110 and extends into slot 130 from first end 132. Pegs 122 on first end and second end of slot are dimensioned to be received by notches 52 in shoe holders 50 of spreader 40.

Figure 6:
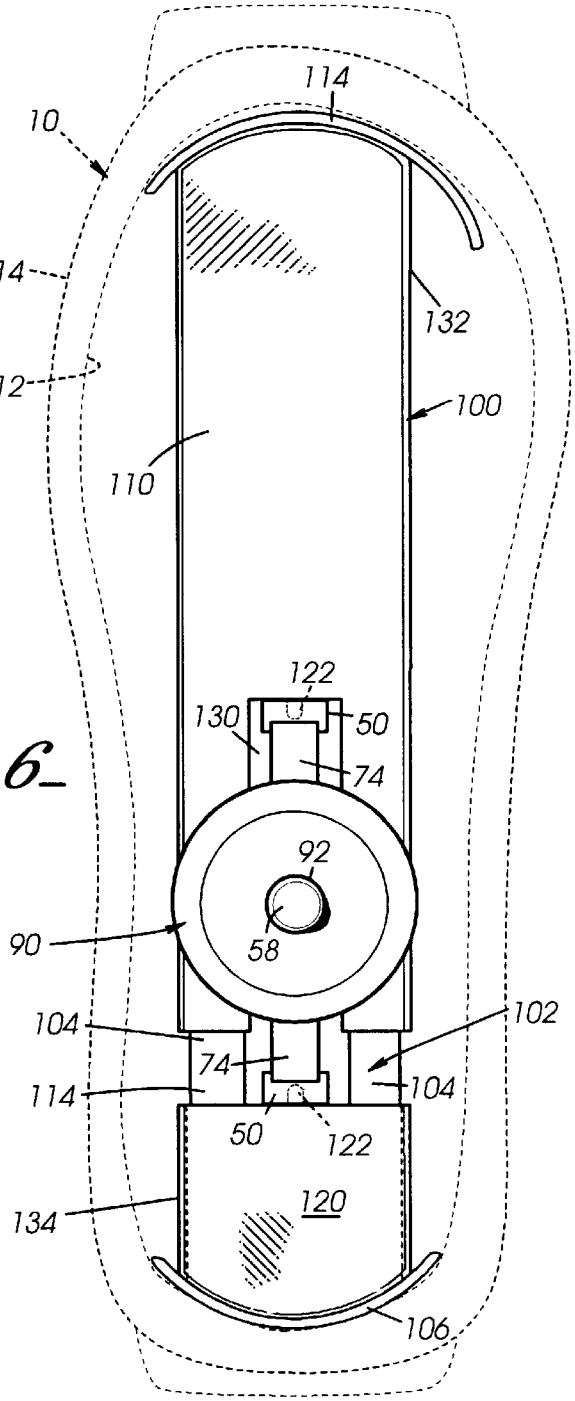
FIG. 6 is a top view of a spreader and an extender positioned together in a ski boot, shown in phantom lines, according to a preferred embodiment of the present invention.
Figure 5:
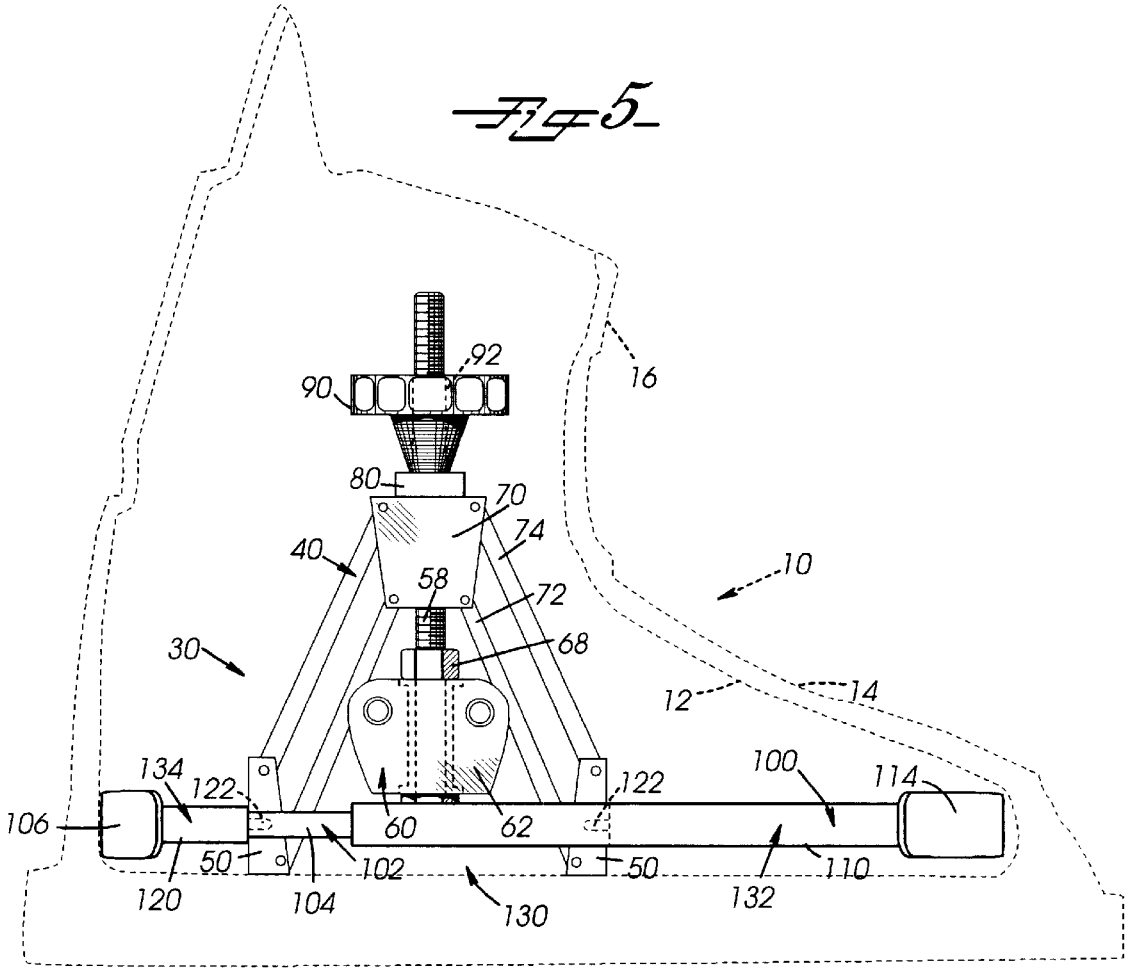
FIG. 5 is a side view of a spreader and an extender positioned together in a ski boot, shown in phantom lines, according to a preferred embodiment of the present invention.
Figure 7:
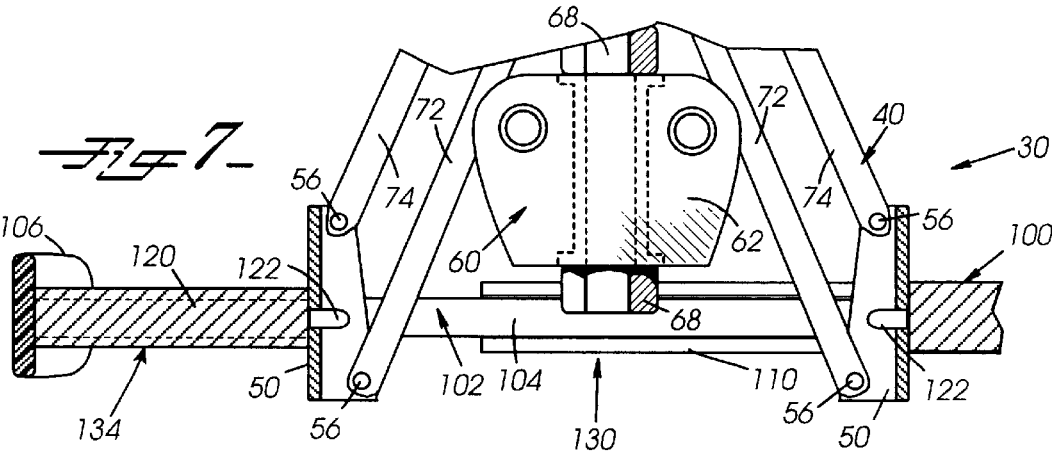
FIG. 7 is a detail view of a spreader engaging the extender according to a preferred embodiment of the present invention.

In operation, to enlarge the toe or heel region of ski boot 10, as shown in FIGS. 5 and 6, spreader 40 is positioned within slot 130 of extender 100 so that notches 52 of shoe holders 50 matingly engage pegs 122 of extender 100. Once in this position, knob 90 can be rotated about threaded rod 58 to decrease the distance between actuator 60, thus forcing shoe holders 50 apart from each other. This action will cause the distance between toe shoe 114 and heel shoe 106 to increase until met by resistance. Once the ends of ski boot 10 are in contact by extender 100, knob 90 can be turned to increase the forces exerted in those regions by the respective shoes 106, 114. Again, the specific area can be enlarged by applying a heat source to outer shell 14 of ski boot 10, thus increasing its elasticity.

Those of ordinary skill in the art will recognize that spacer 120 may be removed from extender 100 and still have extender 100 function. This would be preferable where ski boot 10 is of a relatively small size such that the complete assembly of extender 100 would not fit within ski boot's 10 length. Consequently, by removing spacer 120 and using the modified extender 100 with spreader 40 a relatively smaller ski boot 10 may be locally enlarged with the present invention.

It will be apparent to those skilled in the art that many changes and substitutions can be made to the preferred embodiment herein described without departing from the spirit and scope of the present invention as defined by the appended claims.

What is claimed is:

1. A device for stretching a boot, said device for use with a source of heat in stretching the boot, said device comprising:

a pair of shoes, wherein said one shoe of said pair of shoes has curved ends and is flatter and longer than another shoe of said pair of shoes;

a pair of holders to which said shoes are attached, each shoe of said pair of shoes attached to one holder of said pair of holders;

a pair of arms, each arm having a first end and a second end, said first ends of said arms connected to said holders; and actuator means for moving said arms between a compressed position and an extended position, said second ends of said arms pivotally connected to said actuator so that, when said device is inserted into the boot and said actuator means moves said arms between said compressed position and said extended position, said shoes attached to said holders on said first ends of said arms apply a force to the inside of the surface of the boot whereupon, when said source of heat is applied to heat said boot at the point where said force is applied, said boot stretches where said force is applied as said boot heats.

2. The device as recited in claim 1, wherein said shoes are spaced part when in said extended position and close together when in said compressed position so that, when in said extended position in engagement with the inside of said boot, said shoes apply opposing forces to said boot.

3. The device as recited in claim 1, wherein said actuator means has a threaded hole and said device further comprises a threaded rod running through said threaded hole and a knob an the end of said threaded rod, said actuator means spreading said shoes from said compressed position to said extended position when said knob is rotated and said threaded rod rotates through said threaded hole of said actuator means.

4. The device as recited in claim 1, wherein said holders are pivotally connected to said arms.

5. The device as recited in claim 1, wherein said actuator means further comprises a pair of roller bearings, said pair of arms engaging said roller bearings as said arms pivot between said closed position to said extended position.

6. A device for stretching a boot, said device for use with a source of heat in stretching the boot, said device comprising:

a pair of shoes;

an extender having a first part and a second part slidably attached to said first part, each shoe of said pair of shoes attached to one part of said extender;

a pair of holders engaging said extender, one holder of said pair of holders engaging said first part and another holder engaging said second part of said extender;

a pair of arms, each arm having a first end and a second end, said first ends of said arms connected to said holders; and actuator means adapted to move said arms between a compressed position and an extended position, said second ends of said arms pivotally connected to said actuator so that, when said device is inserted into the boot and said actuator means moves said arms between said compressed position and said extended position, said shoes apply a force to the inside surface of the boot whereupon, when said source of heat is applied to heat said boot at the point where said force is applied, said boot stretches where said force is applied as said boot heats.

7. The device as recited in claim 6, wherein said first and said second parts of said extender slide apart when said arms move to said extended position and slide together when said arms move to compressed position so that, when in said extended position in engagement with the inside of said boot, said shoes apply opposing forces to said boot.

8. The device as recited in claim 6, wherein said actuator means has a knob that is rotated by hand to move said arms between said compressed and said extended positions.

9. The device as recited in claim 6, wherein said one shoe of said pair of shoes is curved and another shoe of said pair of shoes is curved but flatter and longer than said one shoe of said pair of shoes.

10. The device as recited in claim 6, wherein said actuator means has a threaded hole and said device further comprises a threaded rod running through said threaded hole and a knob an the end of said threaded rod, said actuator means spreading said shoes from said compressed position to said extended position when said knob is rotated and said threaded rod rotates through said threaded hole of said actuator means.

11. The device as recited in claim 6, wherein said holders are pivotally connected to said arms.

12. The device as recited in claim 6, wherein said actuator means further comprises a pair of roller bearings, said pair of arms engaging said roller bearings as said arms pivot between said closed position to said extended position.

13. A device for stretching a boot, said device for use with a source of heat in stretching the boot, said device comprising:

a pair of shoes formed to engage the inside surface of said boot, wherein said one shoe of said pair of shoes has curved ends and is flatter and longer than another shoe of said pair of shoes; and actuator means for moving said pair of shoes into engagement with the inside surface of said boot, said shoes movable in parallel to each other by said actuator means so that said shoes apply opposing, equal forces to said inside surface, said pair of shoes being pivotally attached to said actuator means so that said shoes can be brought into engagement with said inside surface at various places within said boot, said actuator means being operable manually.

14. The device as recited in claim 13 wherein said actuator means is adapted to pivot said arms into engagement with the interior of said boot.

15. The device as recited in claim 13, wherein said actuator means moves said shoes into engagement with the interior surface of said boot by spreading said shoes, and wherein said actuator means further comprises:

a knob; and means for converting rotation of said knob to spreading movement of said shoes.

16. The device as recited in claim 13, wherein said actuator means further comprises:

means for holding said shoes;

arms pivotally connected to said holding means; and spreading means pivotally connected to said arms for spreading said arms between a closed position and an open position, whereby, when said spreading means spreads said arms, said arms move into engagement with the interior of said boot.

17. The device as recited in claim 13, wherein said actuator means further comprises:

means for holding said shoes;

arms pivotally connected to said holding means;

an actuator having a threaded hole formed therein and pivotally connected to said arms for spreading said aims between a closed position and an open position, whereby, when said actuator spreads said arms, said arms move into engagement with the interior of said boot;

a threaded rod threadedly received in said threaded hole in said actuator; and means for rotating said threaded rod.

18. The device as recited in claim 17, further comprising a thrust bearing carried by said threaded rod, and wherein said rotating means further comprises a knob attached to said threaded rod.

* * * * *